US005179812A

United States Patent [19]

Hill

[11] Patent Number: 5,179,812

[45] Date of Patent: Jan. 19, 1993

[54] FLOORING PRODUCT

[75] Inventor: Guy C. Hill, Knutsford, United Kingdom

[73] Assignee: Flourlock (UK) Limited, United Kingdom

[21] Appl. No.: 699,155

[22] Filed: May 13, 1991

[51] Int. Cl.[5] ..... E04D 5/82

[52] U.S. Cl. ..... 52/589; 52/480; 52/580

[58] Field of Search ..... 52/578, 580, 581, 480, 52/584–594

[56] References Cited

U.S. PATENT DOCUMENTS 1,045,219 11/1912 Tramill ..... 52/584
3,310,919 3/1967 Bue et al. ..... 52/592
3,619,964 11/1971 Passaro et al. ..... 52/391
4,303,969 12/1981 Hamilton et al. ..... 362/163
4,340,929 7/1982 Konikoff et al. ..... 52/127.7
4,443,989 4/1984 Silvey et al. ..... 52/480
4,635,425 6/1987 Cova ..... 52/480
5,033,241 7/1991 Max ..... 52/71

*Primary Examiner*—James L. Ridgill, Jr.
*Attorney, Agent, or Firm*—Thomas W. Tolpin

[57] ABSTRACT

A flooring product (10) comprises a wood panel having an L-shaped surround (18) the base of which is located below the wood panel. A plurality of parallel aluminium battens (20) are connected to the base of the panel. These battens comprise a groove (30). In use two flooring products (10,50) having similar joint arrangements are secured together by locating the base of the surround (18) of each product in the groove (30) in the elongate members of the other product. The connection can not be disengaged unless one of the flooring products (10,50) is tilted relative to the other.

9 Claims, 6 Drawing Sheets

FLOORING PRODUCT

This invention relates to flooring products and also to portable floors such as dance floors or exhibition floors.

Portable dance floors have been known for many years. These known dance floors comprise a series of panels which may be joined together with screws using specialist tools. The assembly of these floors may be quite complicated and trained staff are usually required to assemble the dance floors correctly.

The present invention has been made from a consideration of this problem.

According to a first aspect of the present invention there is provided a flooring product including a first connecting member operative to releasably engage a second connecting member of a further body, wherein at least one of the connecting members includes means operative to prevent disengagement of the first and second connecting members unless one of said first and second connecting members is inclined relative to the other.

The flooring product preferably comprises both said first and said second connecting members. One of the connecting members may comprise a shoulder adapted to be engaged by the other connecting member. One of the connecting members may comprise an elongate part defining a groove therein. This groove may run transverse to the major axis of the said elongate part. At least one side of the portion of the elongate part defining the groove is preferably inclined. At least one end of the said one connecting member may comprise an inclined part. The flooring product preferably comprises a plurality of spaced apart supports connected to the base of the elongate member. The flooring product preferably comprises a panel of a dance floor or an edging strip.

According to a second aspect of the invention the flooring product includes a first connecting member operative to releasably engage a second connecting member of a further flooring product, wherein at least one of the connecting members defines a shoulder and at least the other connecting member comprises an elongate part defining a groove, wherein on engagement of the shoulder in the groove, the shoulder may not be removed from the groove unless the first connecting member is inclined relative to the second connecting member.

According to a third aspect of the present invention there is provided a portable dance floor comprising a first flooring product and a second flooring product, the first flooring product comprising a plurality of first members and at least one second member, the second flooring product comprising a plurality of first members and at least one second member, the first members of the first flooring product being operative to engage the second member of the second flooring product and the first members of the second flooring product being operative to engage the second member of the first flooring product, wherein at least one of the first members of the first flooring product is operative to abut one side of a first member of the second flooring product and a further first member of the first flooring product is operative to abut the opposite side of at least one first member of the second flooring product so as to restrict lateral movement of the two flooring products.

In order that the invention may be more readily understood a specific embodiment thereof will now be described by way of example only with reference to the accompanying drawings in which.

Figure 1:
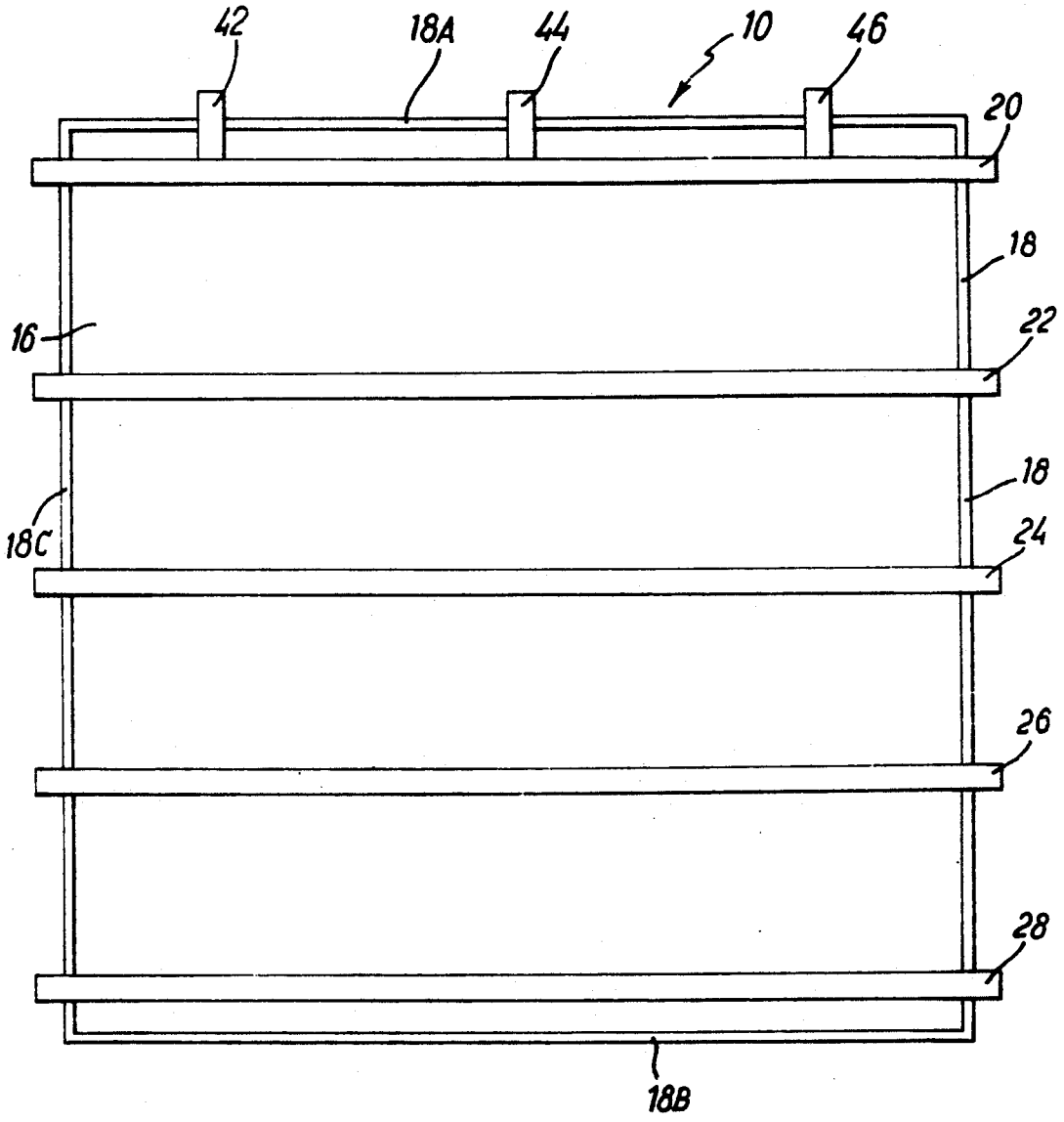
FIG. 1 is an underplan view of one flooring product in accordance with the invention.

Referring to the drawings there is provided a flooring product 10 comprising a panel 12 which consists of a hardwood parquet 14 on a plywood base 16. A hard-wearing acrylic coating is applied to the parquet 14 to protect it from spillages and marking. An L-shaped surround 18 is provided around the periphery of the panel 12 in order to protect the edge of the panel 12. The surround 18 is preferably made from metal and more preferably aluminium.

Five metal battens 20,22,24,26,28 are secured to the base of the panel 12, the battens 20,22,24,26,28 being arranged in a parallel manner with two opposite arms 18A,18B of the surround 18. The battens 20,22,24,26,28 give the flooring product 10 a sprung effect when in use. Each batten 20,22,24,26,28 extends beyond the surround 18 around the panel 12. The ends of the four non central battens 20,22,26,28 comprise a groove 30 which is sufficiently deep to accommodate the horizontal limb 32 of the surround 18. The groove 30 is also of sufficient length to accommodate the horizontal limb 32 of the surround 18 and a second horizontal limb of a further body such as a second similar flooring product or an edging strip.

The edge 34 of the groove 30 that is remote from the surround 18 is outwardly inclined to an uppermost position 36 substantially level with the base of the panel 12. The outer region 38 of the batten 20 descends towards a rounded toe 40.

The central batten 24 does not have the groove arrangement as in use this will contact the length of the edging strip of adjacent flooring products and provides support only and not a connection.

As the battens 20 only extend beyond two arms 18C,18D of the surround 18 three short metal struts 42,44,46 extend from one of the outermost battens 20, beyond another arm 18A of the surround 18. The structure of the struts 42,44,46 is the same as the structure of the end parts of the batten 20.

Figure 2:
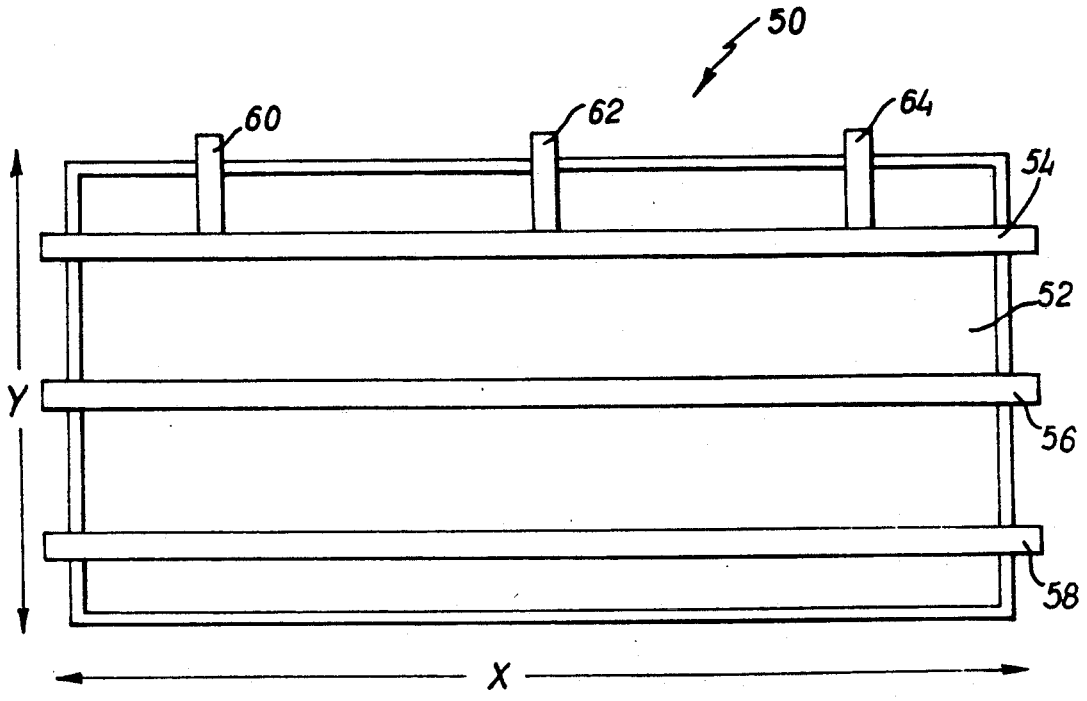
FIG. 2 is an underplan view of a second flooring product in accordance with the invention.
Figure 3:
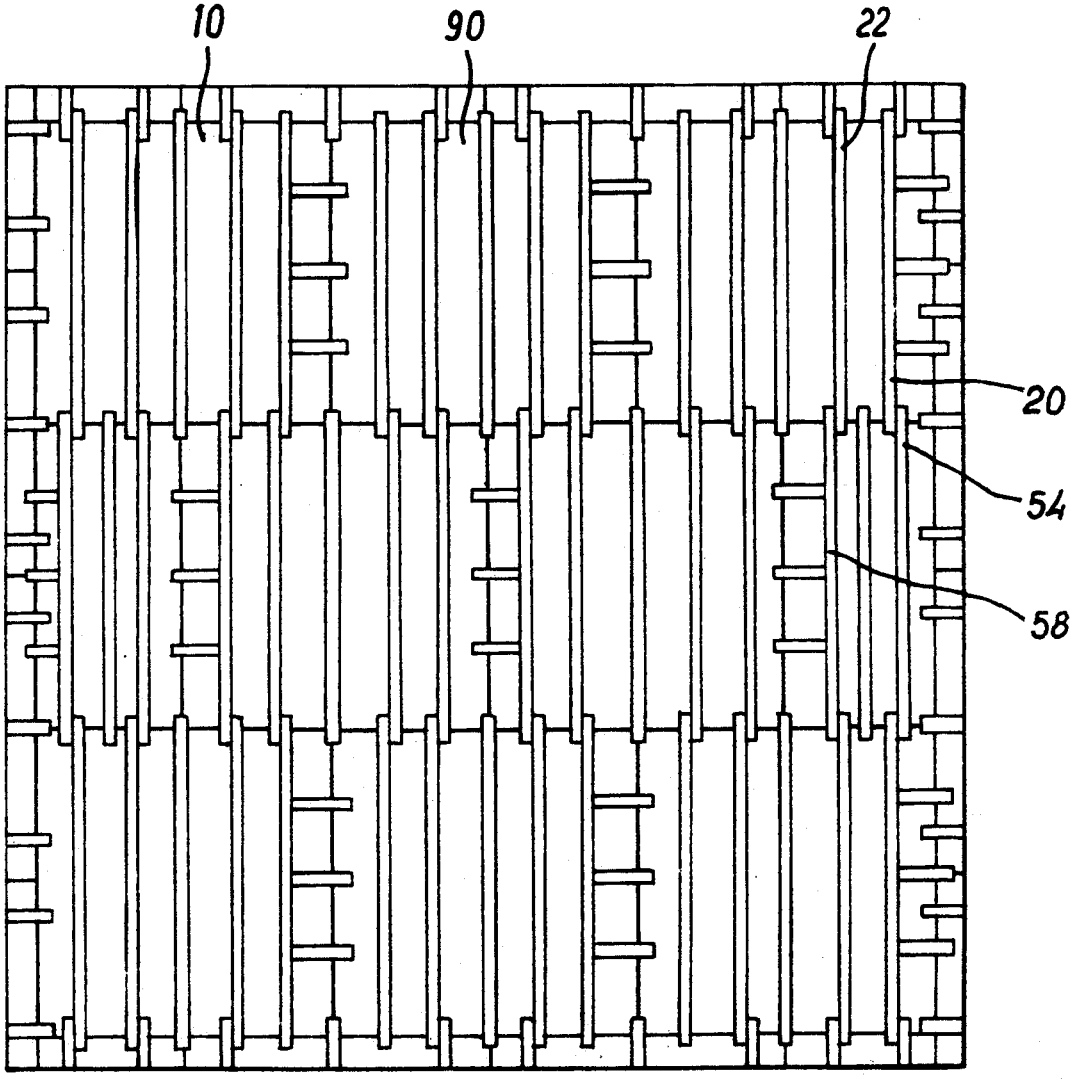
FIG. 3 is an underplan view of a portable floor comprising the flooring products of FIGS. 1 and 2.
Figure 4:
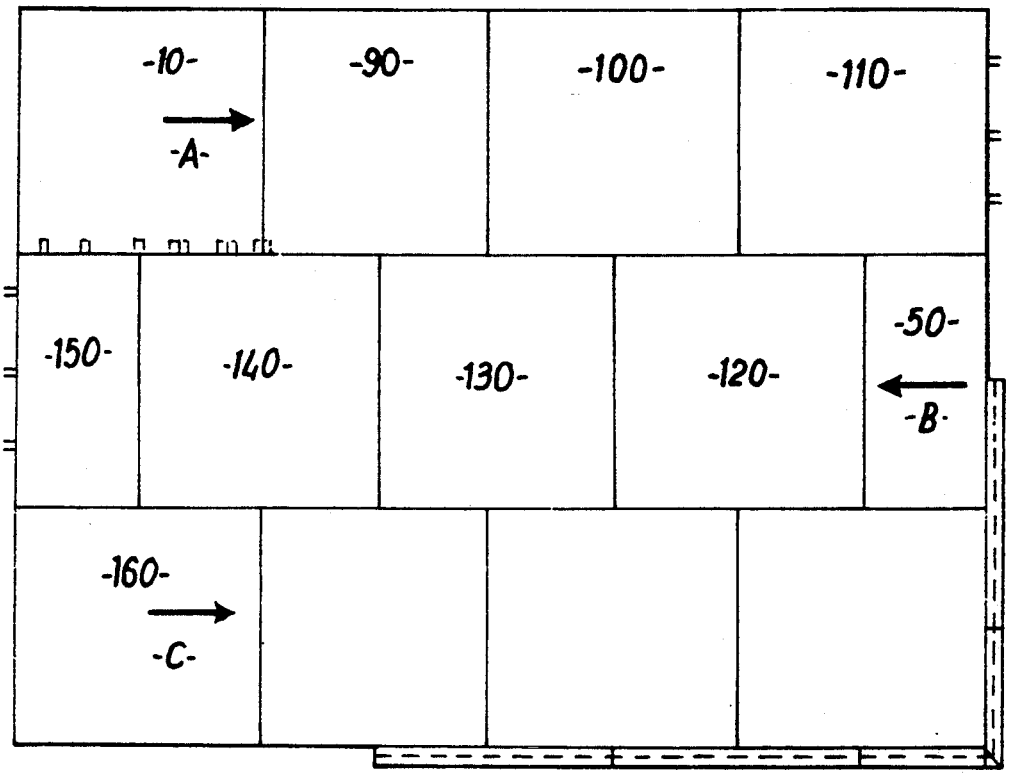
FIG. 4 is a plan view of the portable floor of FIG. 3 showing the order of construction of the floor.
Figure 5:
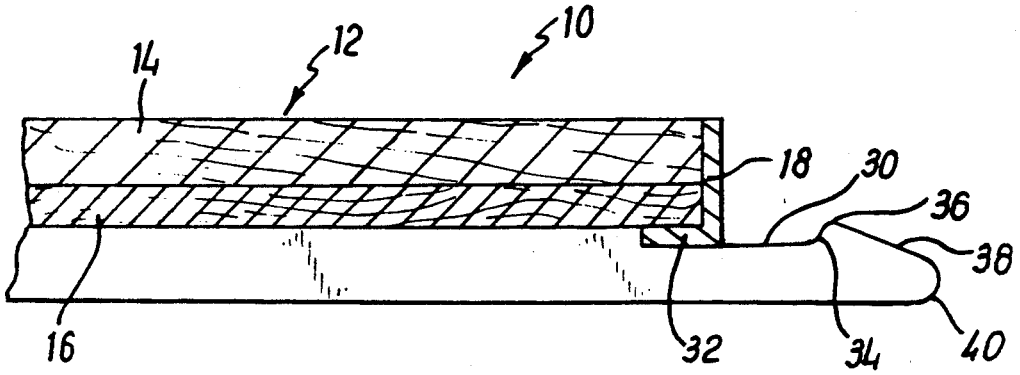
FIG. 5 is a partly cross sectional view of the flooring product of FIG. 1.
Figure 6:
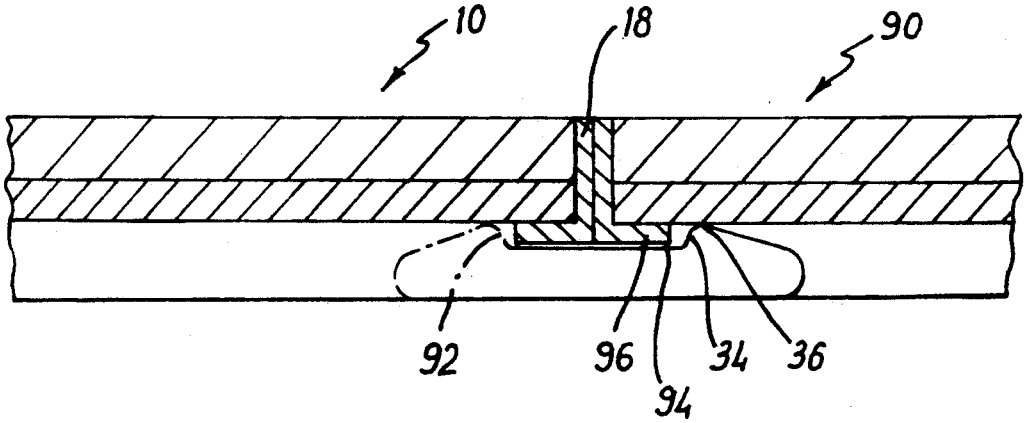
FIG. 6 is a partly cross sectional view of the flooring product of FIGS. 1 to 3 engaged with a second flooring product.
Figure 7:
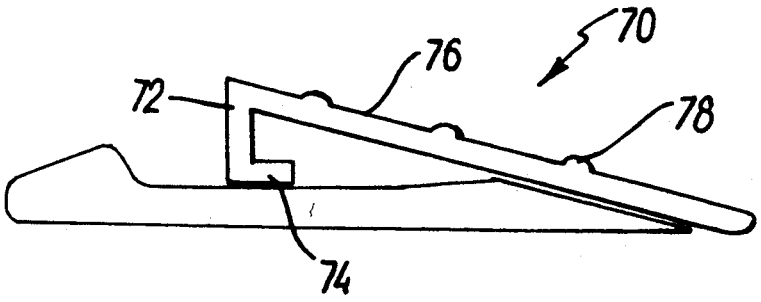
FIG. 7 is a side elevation of an edging strip for engagement with the flooring products of FIGS. 1 to 4.

Referring specifically to FIG. 2 there is shown a second flooring product 50 having a panel 52 of similar width "X", but only half the length "Y" of the first flooring product 10. The second flooring product 50 comprises three battens 54,56,58 and three struts 60,62,64 both of which are of similar construction to these as previously described with reference to FIG. 1.

Figure 8:
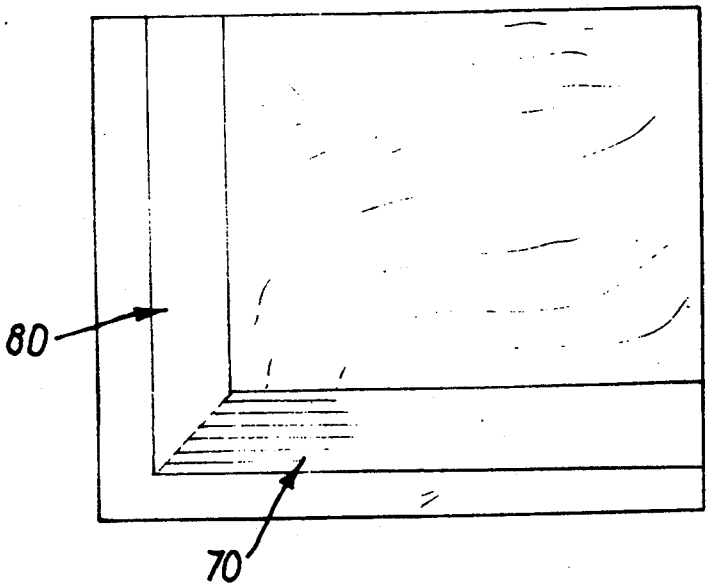
FIG. 8 is a plan view of the flooring product of FIGS. 1 to 5 with two edging strips in position.

Edging strips 70 are provided for use with the flooring products 10,50 so as to provide an inclined edge from the portable dance floor which extends to the permanent floor below. The edging strips 70 comprise a metal plate which comprises a vertical wall 72 having a short horizontal flange 74. The uppermost position of the wall 72 is substantially level with the top of the panel 12 when in use. The remainder 76 of the plate descends from the uppermost position at a small inclined angle to a position level with the base of the battens. A series of parallel ribs 78 extend along the inclined part of the edging strip 70 so as to provide foot grips. The two transverse ends of the edging strips 70 are angled at 45° so as to cooperate with adjacent strips 80 to provide a flush joint as shown in FIG. 8.

In order to construct the portable floor the flooring product 10 is placed on the floor. A second similar floor product 90 is located next to the first flooring product 10. In order to connect the two flooring products 10,90 together edge 18B of the surround of one flooring product 90 is dropped into the grooves 30 provided in the struts on flooring product 10. Flooring products 100 and 110 are connected to flooring products 90 and 100 respectively in a similar manner forming a first row "A" of flooring products. In order to connect the first row "A" of the flooring products to an adjacent row "B" a half sized flooring product 50 is inclined relative to the flooring product 110 such that the bevelled edge 92 of the groove of the second flooring product 90 is substantially level with the base of the surround 18 of the first flooring product 110 and the base corner 94 of the surround 96 of the second flooring product 90 is clear of the tip 36 above the groove 30 of the first flooring product 110. The two flooring products 110,50 are pushed together until the respective surrounds 18,96 engage and the second flooring product 50 is then dropped into position.

A further flooring product 120 can be connected to the adjacent flooring product 100,110 in the first row "A" in the same manner as the flooring product 50 was connected to flooring product 110. The flooring product 120 is connected to the flooring product 50 in the same row "B" simply by dropping edge 18B of the surround 18 into the grooves in the struts of flooring product 50. Flooring products 130 and 140 are laid in a similar manner and the second row "B" is finished with a half sized panel 150.

An additional flooring product 160 similar to that illustrated in FIG. 1 is laid to the side of that half sized flooring product 150 and subsequently further flooring products are laid in the direction of arrow C in the same manner as laying the products of row "B" until the floor panel area is complete.

Once all of the flooring panels are in position the edging strip is placed around the floor area.

It is noted that the spacing of the battens 54,56,58 of the half size panels 50 is such that when in use one of the battens 54 abuts one side of a batten in the adjacent panel 10 and another of the battens 58 abuts another side of a different batten 22 of that panel 10. This prevents relative lateral movement of the two flooring products 10,50.

Once in position the flooring products will not accidentally become disengaged from adjacent connected flooring products as separation is prevented owing to engagement of the inclined portions 34,92 of one flooring product with the free end of the surround 18,96 of the adjacent flooring product. Also lateral movement is prevented by the arrangement of the battens 20,22,54,58.

Any two flooring products in adjacent rows A,B,C may be disengaged by tilting one of the flooring products relative to the other until the tips of the inclined portions move free of the free ends of the surround of the adjacent flooring product.

The above described flooring product facilitates the quick and easy construction of a portable dance floor without the need for specially trained staff or specialist tools. Also the flooring product offers the advantage that the joint with adjacent flooring products tightens up under load.

The flooring products of the present invention are usually of relatively low weight for example a square 34 inch panel has a weight of about 14 kg and therefore the panels are easy to carry by hand.

It is to be understood that the above described embodiment is by way of illustration only. Many modifications and variations are possible.

For example any number of battens or struts may be provided. The panel may be of any suitable size or shape. However, square and rectangular panels are preferred. The panels, battens or struts may be made from any suitable material. For example the panels may comprise any suitable wood or synthetics material and the battens and struts may comprise any suitable synthetic material or metal such as aluminium.

I claim:

1. A flooring product, comprising a panel with a base, a surround peripherally surrounding and secured to said base, a set of battens secured to said base and extending outwardly of said surround, struts extending from one of said battens and extending outwardly of said surround, said battens having end portions defining grooves for securely receiving said surround and an adjacent surround of another substantially similar flooring product, and said battens, struts, and grooves cooperating with each other to matingly engage and interlockingly connect substantially similar flooring products for securely assembling a portable floor in the absence of screws and nails, said flooring products being disengageable from said floor when said flooring products are inclined relative to the other.

2. A flooring product as claimed in claim 1 in the absence of locking means comprising a fastener.

3. A flooring product as claimed in claim 1, wherein said end portions have a rounded toe and an outwardly inclined edge having a height rising to about the elevation of said base of said panel.

4. A flooring product as claimed in claim 1, wherein said surround has a substantially L-shaped cross-section with a substantially horizontal limb for engaging the grooves of said battens.

5. A flooring product as claimed in claim 1, wherein said panel comprises a hardwood parquet with an acrylic coating, said base comprises a plywood base, said battens comprise metal battens, and said struts comprise metal struts.

6. A flooring product as claimed in claim 1, wherein the flooring product comprises an edging strip providing an inclined edge from said portable floor, said edging strip comprising a plate with a substantially horizontal flange, an upright wall extending substantially vertically from said horizontal flange to atop of said panel, a sloping portion extending downwardly from said upright wall at an angle of inclination, and a series of ribs protruding upwardly from said sloping portion for providing foot grips.

7. A flooring product, comprising a panel with a base, a surround peripherally surrounding and secured to said base, a series of battens secured to said base and extending outwardly of said surround, struts extending from one of said battens to a position outwardly of said surround, said battens having end portions defining grooves for securely receiving said surround and an adjacent surround of another flooring product, and said battens, struts, and grooves cooperating with each other to matingly engage and securely connect said other flooring product in a substantially horizontal position to form part of a floor and said flooring product being moveable to an inclined position relative to the other flooring product to disengage and remove the flooring products.

8. A portable floor comprising an array of interengaging flooring products, said flooring products being securely arranged in a substantially stationary horizontal position in the absence of screws and nails for sue as a portable floor and being moveable to a detachable inclined position in which some of said flooring products are tilted an an angle of inclination relative to other of said flooring products for detachment and removal of said flooring products, said portable floor including means for abutting against and securely engaging said flooring products in opposite directions to substantially restrict movement of said flooring products.

9. A portable floor as claimed in claim 8, wherein some of said flooring products are about one half the length of said other flooring products.

* * * * *

UNITED STATES PATENT AND TRADEMARK OFFICE

CERTIFICATE OF CORRECTION

PATENT NO. : 5,179,812

DATED : January 19, 1993

INVENTOR(S) : Hill, Guy C.

It is certified that error appears in the above-indentified patent and that said Letters Patent is hereby corrected as shown below:

On the title page, Item [73] Assignee: "Flourlock" should be --Florlok--.

Signed and Sealed this

Twenty-ninth Day of March, 1994

Bruce Lehman

*Attest:*

BRUCE LEHMAN

*Attesting Officer*

*Commissioner of Patents and Trademarks*